US006982415B2

(12) United States Patent
Kovtoun

(10) Patent No.: US 6,982,415 B2
(45) Date of Patent: Jan. 3, 2006

(54) CONTROLLING ION POPULATIONS IN A MASS ANALYZER HAVING A PULSED ION SOURCE

(75) Inventor: Viatcheslav V. Kovtoun, Santa Clara, CA (US)

(73) Assignee: Thermo Finnigan LLC, San Jose, CA (US)

( * ) Notice: Subject to any disclaimer, the term of this patent is extended or adjusted under 35 U.S.C. 154(b) by 0 days.

(21) Appl. No.: 10/764,269

(22) Filed: Jan. 23, 2004

(65) Prior Publication Data

US 2004/0200959 A1 Oct. 14, 2004

Related U.S. Application Data

(60) Provisional application No. 60/442,368, filed on Jan. 24, 2003, and provisional application No. 60/476,473, filed on Jun. 5, 2003.

(51) Int. Cl.
*H01J 49/00* (2006.01)

(52) U.S. Cl. ..... 250/282; 250/281; 250/287

(58) Field of Classification Search ..... 250/281, 250/282, 287, 286, 288
See application file for complete search history.

(56) References Cited

U.S. PATENT DOCUMENTS 5,396,065 A * 3/1995 Myerholtz et al. ..... 250/287

* cited by examiner

*Primary Examiner*—Kiet T. Nguyen
(74) *Attorney, Agent, or Firm*—Fish & Richardson P.C.; Sharon Upham

(57) ABSTRACT

A mass spectrometer is operated by generating a test packet of ions from a pulsed ion source. A population of ions derived from the test packet of ions is detected. A number of ionization events of the pulsed ion source is determined that will be required to provide an analysis packet of ions expected to have a desired population of ions. An analysis packet of ions is produced by accumulating ions for the determined number of ionization events.

39 Claims, 4 Drawing Sheets

CONTROLLING ION POPULATIONS IN A MASS ANALYZER HAVING A PULSED ION SOURCE

CROSS-REFERENCE TO RELATED APPLICATIONS

This application claims the benefit of U.S. Provisional Application No. 60/442,368, filed on Jan. 24, 2003, and U.S. Provisional Application No. 60/476,473, filed on Jun. 5, 2003, both of which are incorporated by reference herein.

BACKGROUND

The invention relates to controlling ion populations provided by pulsed ion sources for subsequent processing, manipulation, and/or analysis. In particular, this invention relates to controlling ion populations provided by a pulsed ion source in ion storage type mass analyzers, such as radio frequency (RF) quadrupole ion trap mass spectrometers.

Ion storage type mass analyzers, such as RF quadrupole ion traps, ICR (Ion Cyclotron Resonance) and FTICR (Fourier Transform Ion Cyclotron Resonance) mass analyzers, function by transferring generated ions via an ion optical means to the storage/trapping cells on the mass analyzer, where the ions are then analyzed. One of the major factors that limit the mass resolution, mass accuracy and the reproducibility in such devices is space charge, which can alter the storage, trapping conditions, or ability to mass analyze of an ICR or ion trap, from one experiment to the next, and consequently vary the results attained.

One way to improve the reproducibility of results, the mass resolution and accuracy in ion storage type devices is to control the ion population that is stored/trapped, or otherwise confined, and subsequently analyzed in the mass analyzer.

Space charge effects arise from the influence of the electric fields of ions confined in the analyzer device upon each other. At very high levels of space charge, the mass resolution obtainable will deteriorate, and spectral peaks will shift in m/z. The greatest scan to scan variation in the magnitude of the space charge effect arises from differences in trapped ion numbers or population, caused by variations in the brightness of the source of ions (flux of ions). Unless space charge is either taken into account or regulated, high mass resolution and mass accuracy measurements can not be reliably achieved.

Optimum performance can relate to different criteria, such as avoidance of an excessive space charge, space charge constancy over a number of measurements, adaptation to special characteristics of the mass analyzer, and the like. Hence the optimum performance of a device is generally defined by an upper and a lower limit of ion population. Thus, for example, for low ion populations in the mass analyzer, it can be difficult to differentiate the detected population of ions from the noise level. Increasing the population of ions in the analysis chamber of the mass analyzer can avoid this problem. For high ion populations in the mass analyzer, increasing the population of ions too far can lead to space charge problems, resulting in deterioration in m/z assignment accuracy.

Different ion sources can be used in conjunction with mass analyzers. These include pulsed ion sources, which, as used in this specification, are ion sources that are operable to provide non-continuous ionization events (resulting in ion pulses or packets) separated by periods when ionization events are minimized, such as sources that use lasers to desorb analyte molecules from a surface. Common examples of such sources are the matrix assisted laser desorption ionization (MALDI) ion source as illustrated in FIG. 1, or the surface enhanced desorption ionization (SELDI) ion source. In this ionization method, molecules of an analyte are embedded in a layer of crystals of a typically low-molecular weight matrix substance, and this "sample" is typically disposed on a sample plate.

A laser pulse 105 (typically a pulse of a few nanoseconds duration) is directed at the sample plate 110 and provides energy to desorb both the matrix 115 and analyte 120, and to obtain efficient generation of analyte ions, without decomposing the analyte molecules. The power of the laser pulse is selected to optimize the signal of the mass analyzer. The matrix 115 plays a key role in this technique by absorbing the laser light energy and causing part of the illuminated substrate to vaporize. The matrix molecules absorb most of the incident laser energy, minimizing sample damage and fragmentation. The host matrix is selected to absorb radiation at the wavelength of the laser being used. The vapor cloud 125 that is produced is initially under substantially high pressure, occupying relatively little space. However, the vapor cloud eventually begins to expand into the (typically) evacuated chamber in which it has been generated.

Because it uses a laser pulse to generate the ions, a MALDI source 100 therefore produces ions in a pulsed fashion, in ion packets. Each packet represents a pulse within which the ions are distributed spatially. An ion packet comprises ions derived from the ions generated from the MALDI ion source. As used in this specification, ions "derived from" ions provided by a source of ions include the ions generated by a source of ions as well as ions generated by manipulation of those ions as will be discussed in more detail below.

The surfaces of the analyte/matrix mixture on the sample plate can be quite inhomogeneous, which can lead to signal variations over the surface of the target.

Once the sample ions and molecules are vaporized and ionized, they transfer electrostatically into the mass analyzer, for example a two or three dimensional quadrupole ion trap or a Fourier Transform Mass Spectrometer(FT-MS), where they are separated from the matrix ions, are individually detected based on their mass-to-charge (m/z) ratios, and analyzed.

In general, the optimum performance of the ion trap mass analyzer is achieved when the ion population generated in a single or multiple laser shots is characterized by maximum signal/noise ratio, but still is below the threshold of onset of significant space charge effects.

SUMMARY

The invention provides methods and apparatus, including computer program products, implementing techniques for controlling the amount of charge (or the number of ions) produced by a pulsed source of ions. This controlled amount of charges or number of ions can be the final population of ions before mass analysis. The mass analyzer includes an ion trapping type device, such as a multipolar ion trap, ICR, orbitrap, trap-TOF or an FTICR cell. In general, the techniques involve the acquisition of data with a sample number of pulsed ionization events, the data being indicative of how many ions one may expect to obtain in a series of subsequent pulsed ionization events.

In general, in one aspect, the invention provides methods and apparatus, including computer program products, implementing techniques for operating a mass spectrometer including a pulsed ion source. The techniques include generating a test packet of ions from the pulsed ion source, and determining a desired number of ionization events for a final analytical scan. The optimum number of ionization events is a number of events that is expected to produce a desired population of ions.

In general, in another aspect, the invention provides methods and apparatus, including computer program products, implementing techniques for operating a mass spectrometer. The techniques include generating a test packet of ions from a pulsed ion source, detecting a population of ions derived from the test packet of ions, determining, based on the detected population, a number of ionization events of the pulsed ion source required to provide an analysis packet of ions expected to have a desired population of ions, and generating an analysis packet of ions by accumulating ions for the determined number of ionization events.

Particular implementations can include one or more of the following features. Generating a test packet of ions can include firing a laser a pre-determined number of times to generate the test packet of ions. The test packet of ions can be accumulated in an ion storage device. An analysis packet of ions can be generated by firing the desired number of laser shots. The analysis packet of ions can be accumulated in an ion storage device, and analyzed in the mass analyzer. The mass analyzer can include the ion storage device.

The test packet can be generated by firing a predetermined number of laser shots at an analyte disposed on a sample plate. The number of pulsed ionization events can be determined based on the detected population includes estimating an accumulated ion charge of the accumulated test packet of ions. The ion storage device can include a multipole ion guide. Substantially all ions derived from the test packet of ions can be removed from the ion storage device before accumulating ions for the determined number of ionization events. The number of ionization events can be determined by determining a number of laser shots required to provide an analysis packet of ions expected to have a desired population of ions, and ions can be accumulated for the determined number of laser shots to provide the analysis packet of ions. At least a portion of the analysis packet of ions can be transferred to a mass analyzer of the mass spectrometer. The pulsed ion source can be a MALDI ion source. The ions derived from the test packet of ions can be ions in the test packet of ions.

The test packet of ions can be generated by generating one or more pulses of ions in the pulsed ion source, accumulating the-ions in the generated pulses of ions, and generating product ions from the ions accumulated from the generated pulses of ions. Detecting a population of ions derived from the test packet of ions can include detecting at least a portion of the generated product ions. The analysis packet of ions can include product ions generated from the ions accumulated for the determined number of ionization events. The desired population of ions can be defined as a population of ions expected to have a desired behavior in the mass analyzer or the ion storage device.

The analysis packet of ions can be generated by accumulating ions for a determined number of laser shots that is less than, equal to, or greater than the predetermined number of laser shots. The analysis packet of ions can be generated by generating ions for the determined number of laser shots and accumulating an attenuated amount of the generated ions to provide the analysis packet.

The invention can be implemented to provide one or more of the following advantages. The analysis population of ions can undergo manipulation and/or further processing prior to injecting ions into the mass analyzer. Alternatively, the analysis population of ions accumulated and/or introduced into the mass analyzer can be controlled to reduce or eliminate space charge effects. Controlling the amount of charge (or the number of ions) in the final m/z analysis population in an ion storage type mass analyzer increases the probability of attaining meaningful results in final analysis. In $MS^n$ experiments, both the population of precursor ions or the population of product ions can be controlled. Unwanted ions can be removed from the ion stream before ions are introduced into the mass analyzer, resulting in improved sensitivity, accuracy, resolution and speed of the measurement achieved by the mass analyzer. The techniques described herein can be particularly valuable for low concentration samples.

Unless otherwise defined, all technical and scientific terms used herein have the meaning commonly understood by one of ordinary skill in the art to which this invention belongs. In case of conflict, the present specification, including definitions, will control. Unless otherwise noted, the terms "include", "includes" and "including", and "comprise", "comprises" and "comprising" are used in an open-ended sense—that is, to indicate that the "included" or "comprised" subject matter is or can be a part or component of a larger aggregate or group, without excluding the presence of other parts or components of the aggregate or group. The details of one or more embodiments of the invention are set forth in the accompanying drawings and the description below. Other features and advantages of the invention will become apparent from the description, the drawings, and the

BRIEF DESCRIPTION OF THE DRAWINGS

Like reference numbers and designations in the various drawings indicate like elements.

DETAILED DESCRIPTION

The invention provides techniques for controlling a population of ions to undergo manipulation, further processing, and/or to be analyzed in a mass spectrometer having a pulsed ion source. In one implementation, a test packet of ions is generated over a sample number of pulsed ionization events. A population of ions derived from the test packet of ions is detected, and the detected population is used to determine a number of ionization events of the pulsed ion source that is expected to be required to provide an analysis packet of ions having a desired or optimum population of ions. The optimum population may relate to the either the charge density, which takes into consideration both the number of charges and the actual charge on each ion (which is often a singly charged ion for MALDI), or the ion density, which takes into consideration the number of ions and assumes that the charge associated with every selected ion is the same (and usually one). An analysis packet of ions is then generated, for example by accumulating ions over the determined number of ionization events to provide the desired or optimum ion population. The analysis packet is then manipulated, further processed and/or analyzed in a mass analyzer of the mass spectrometer.

Figure 1:
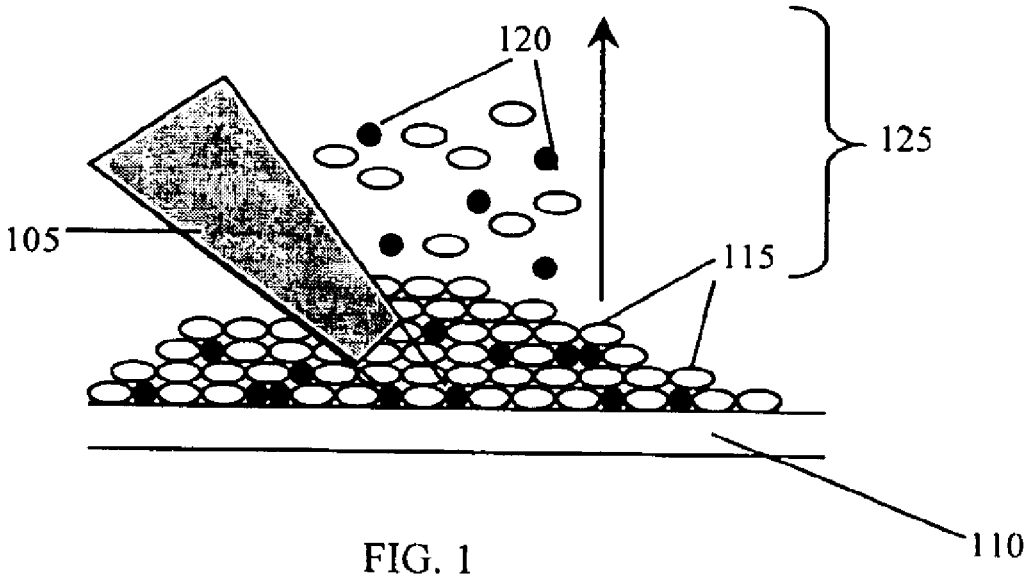
FIG. 1. is a schematic illustration of a pulsed ion source ion source.
Figure 2:
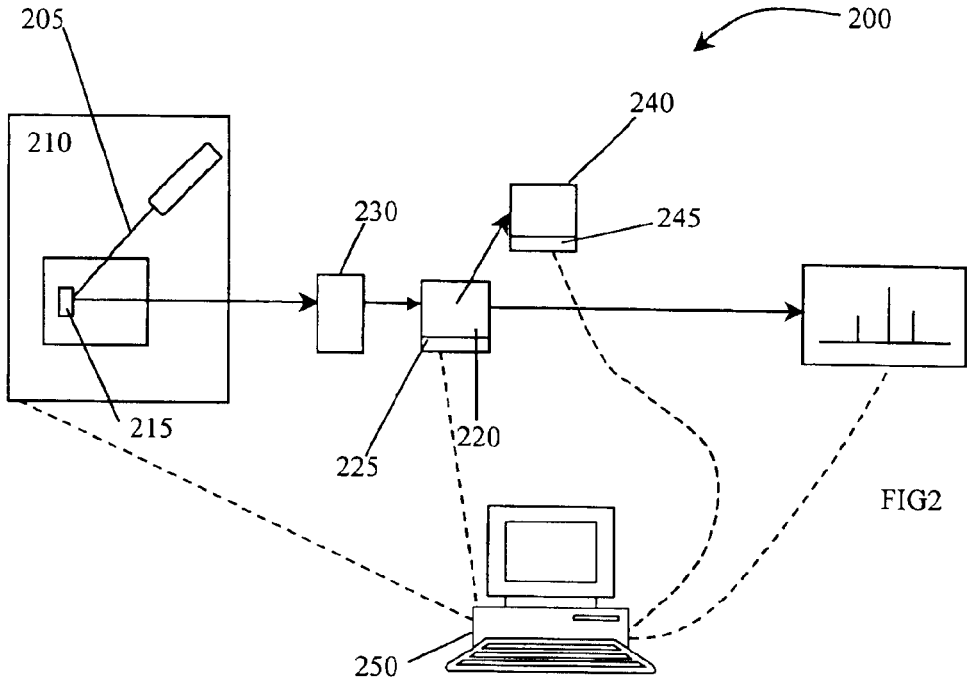
FIG. 2 is a schematic illustration of an apparatus implementing a method for controlling ion populations in a mass analyzer according to one aspect of the invention.

As illustrated in FIG. 2, an apparatus/system 200 that can be used to control ion populations in a quadrupole ion trap mass spectrometer according to one aspect of the invention includes a pulsed ion source 210 (here, a MALDI ion source) in communication with an RF quadrupole ion trap mass analyzer 220 (with associated ion trap mass spectrometer electronics 225), and a detector 240 (with associated detector electronics 245). Some or all of the components of system 200 can be coupled to a system control unit, such as an appropriately programmed digital computer system 250, which receives and processes data from the various components and which can be configured to perform analysis on data received.

Once the ions have left the ion source 210, they may traverse various ion guides, ion optical elements, or other ion transfer optics (230) before entering the RF quadrupole ion trap 220. These ion transfer optics or ion beam qualification means (230) may have m/z filtering properties and may be used to precondition the beam entering the RF quadrupole ion trap 220. The ion transfer optics can include multiple RF multipole guides, tube lenses, "ion tunnels" comprising a plurality of RF electrodes having apertures through which ions are transmitted, and/or aperture plate lenses/differential pumping orifices.

Thus the ion transfer optics 230 facilitate the transfer of ions from the pulsed ion source 210 which may be at high pressure relative to the RF quadrupole ion trap 220 in various steps. Typically, there can be in the neighborhood of three multipole ion guides between the pulsed ion source 210 and the RF quadrupole ion trap 220. For example, in one implementation, the ion transfer optics 230 comprise a quadrupole at 100–200 mtorr, coupled via a skimmer to a second quadrupole at 0.06–0.6 mtorr, coupled through a lens to an octopole at (0.5–1)e-5 Torr, terminating with a lens before entering the RF quadrupole ion trap 220.

The ions initially trapped in the quadrupole ion trap 220 can be manipulated before detection—for example, undesired ions can be ejected at this point to limit the m/z range of ions or to isolate a specific narrow m/z range to be further analyzed.

Figure 3:
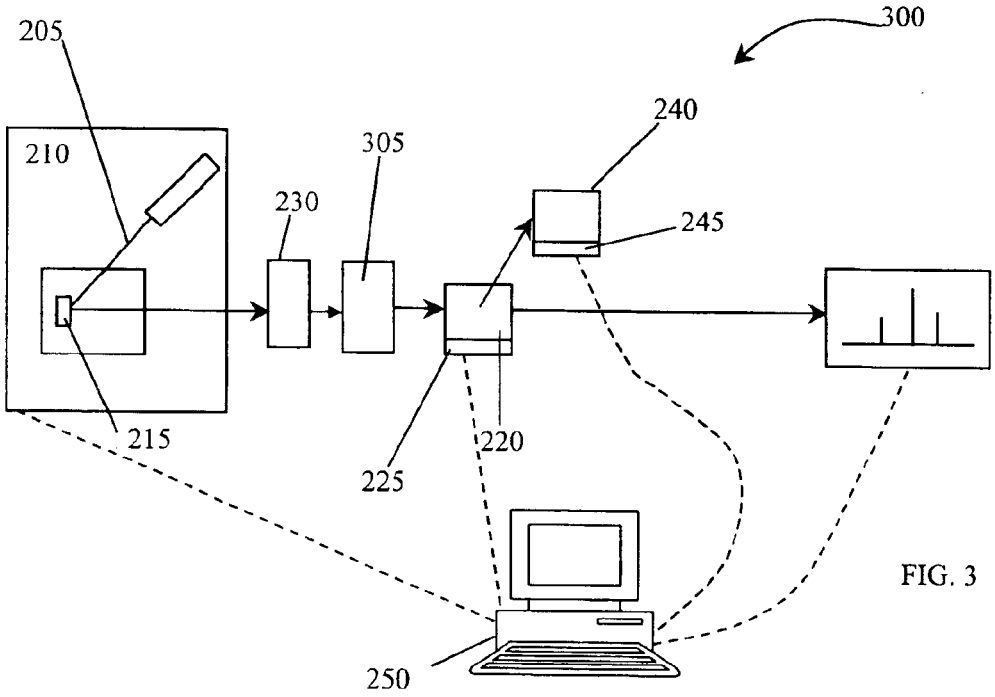
FIG. 3 is a schematic illustration of an alternative implementation of an apparatus according to FIG. 2, incorporating an intermediate ion trap.

FIG. 3 illustrates an alternative embodiment, in which an apparatus/system 300 comprises an ion storage device or ion trap 305. This may be a multipole ion guide, an octopole or a linear trap. In one implementation, the storage device 305 is an RF multipole with additional electrodes, typically interquad apertures and/or endplates, based on a higher order multipole RF field, such as a RF multipole linear trap.

The storage device 305 can also serve as a fragmentation cell, such that ions that have or acquire sufficient kinetic energies upon collision with atoms or molecules of an appropriate background gas (argon, nitrogen, xenon, etc.) undergo collisionally activated decomposition. The system 300 can include ion transfer optics (230) as described above, such as RF multipole ion guides.

In the operation of system 300, a population of ions is collected in the storage device 305, and is then transferred in a single step or multiple steps to the RF quadrupole ion trap 220. The total charge of ions deposited in the storage device 305 should not exceed the amount of charge that, when finally transported (after any losses in transport or capture) to the RF quadrupole ion trap 220 will allow the manipulation and m/z analysis of the ions in the RF quadrupole ion trap 220 to proceed in an optimized manner (i.e., to give results with a desired m/z accuracy, m/z resolution, isolation width, dynamic range, etc.). The charge capacity of the storage device 305 should be sufficiently large (when performing the functions of ion capture, trapping, and extraction) so as not to be a limiting factor in the performance of the quadrupole ion trap 220.

The storage device 305 can be optimized for the extraction of ions to optimize their transport to and capture in the RF quadrupole ion trap 220. Such a storage device 305 can be designed to provide for the imposition of a DC gradient along the axis of the device during the extraction process.

The pulsed ion source is an ion source that is operable to provide non-continuous ionization events (resulting in ion pulses or packets) separated by periods when ionization events are minimized, such as by firing a laser at a substrate upon or in which an analyte of interest is deposited to vaporize and generate analyte ions. Suitable pulsed ion sources can include MALDI sources, as well as various other laser desorption sources with or without (e.g. a surface enhanced laser desorption ionization sources—SELDI) matrix added to the analyte. Moreover, the pulsed ion source can be a conventional continuous ion source that is operated to provide non-continuous ionization events. The following embodiments are described in reference to a MALDI source.

Referring to FIG. 2, the MALDI source 210 generates ions by directing the laser beam 205 at a sample plate 215. Ions generated by MALDI are received (directly or indirectly) by the RF quadrupole ion trap 220. A pre-scan measurement is used to estimate the accumulated ion charge (AIC) in order to determine how many pulses are required to fill the RF quadrupole ion trap 220 to a level providing high sensitivity, substantially no space charge effects, and good mass accuracy. The manner of handling the separate ion packets used for the AIC test and final full-scan analysis is described in more detail below.

A fixed number of laser shots may be applied first to remove the upper layer of the sample on the sample plate.

The upper layer typically carries a substantial number of matrix clusters and contaminants. The initial desorption facilitated by these initial shots is generally characterized by a low analyte signal buried in chemical noise and a poor signal to noise ratio. More meaningful final analysis results can be attained by preventing these few sample ions from entering the RF quadrupole ion trap 220, and not considering them representative of the following more useful laser shots.

In addition, the RF injection level in the RF quadrupole ion trap 220 may be manipulated to remove all low-mass ions associated with the MALDI matrix. This typically involves the removal of all mass ions below approximately 600 amu (atomic mass units) before the AIC sample is taken. Alternatively, an injection waveform is applied to the ion trap such that masses that are not of interest are selectively removed from the trap, and those that are of interest are retained. This manipulation may occur during or after injection of ions into the ion trap 220.

Figure 4:
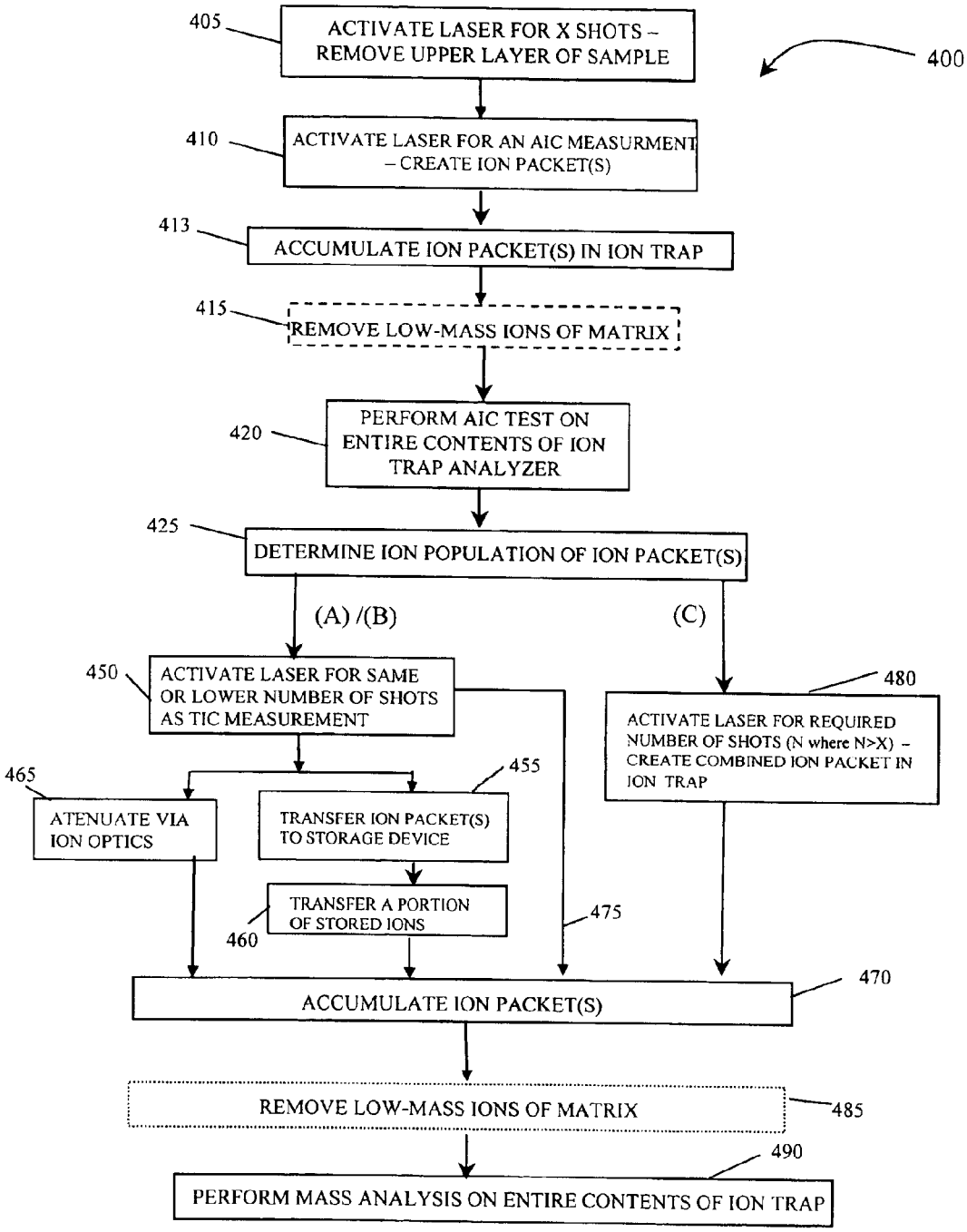
FIG. 4 is a flow diagram illustrating an implementation of a method according to one aspect of the invention.

FIG. 4 illustrates a method 400 of controlling ion population in a mass analyzer according to one aspect of the invention. The method begins by firing a fixed number of laser shots at the sample on the sample plate to remove the upper layer of the sample containing matrix clusters and contaminants (step 405). The laser is then fired for one or more shots in order to generate an ion packet or a combined ion packet for a AIC measurement (step 410). Where multiple shots are fired, the number of shots is typically smaller than the number eventually required for the analytical scan. The number of laser shots will typically be from 1 to 5 shots.

The ions generated by the laser shots of step 410 are accumulated and combined to create a combined ion packet (step 413). The combined ion packet includes ions derived from the ions generated by the MALDI ion source. The ions can be directly accumulated in the quadrupole ion trap 220—that is, without storage of ions in an intermediate storage device. The accumulation of ions in step 413 should proceed for an amount of time sufficient to ensure the substantially complete transfer and accumulation of substantially the entire ion packet (including the ions with the lowest ion mobility) into the quadrupole ion trap 220. Otherwise, pre-experiment AIC data may not be fully representative of the entire ion packet.

In one aspect of the invention, RF quadrupole ion trap 220 is operated such that the matrix ions, those ions with a m/z below a particular value, are removed prior to any AIC measurement being taken. Alternatively, the purging of the matrix ions can be accomplished before the ions reach the RF quadrupole 220, in the ion transfer optics 230 (step 415).

The RF quadrupole ion trap 220 is operated such that ions are ejected towards detector 240, which detects the ejected ions. Detector 240 can be any conventional detector that can be used to detect ions or the accumulated ion charge (AIC) ejected from quadrupole ion trap 220. In one implementation, detector 240 can be an electron multiplier detector or an analog electrometer.

The pre-experiment AIC test is performed on substantially the entire accumulated content of the quadrupole ion trap 220 (step 420). Performing an AIC test includes detecting a signal from the accumulated ion population stored in the ion storage device or the RF quadrupole ion trap. AIC may be measured by ejecting the accumulated ion population from the ion storage device (which may be the RF quadrupole ion trap) for detection by one or more electron multipliers or similar detectors. Alternatively the image current induced by the orbits of the ions in the ion storage device may be measured using suitable detection circuits. Based on the results of the AIC test, it is possible to estimate, at least in a relative sense, how many ions were originally accumulated in the quadrupole ion trap 220 (step 413).

The pre-experiment AIC test may show one of three things —that the estimated number of ions either (A) exceeds, (B) is approximately equal to, or (C) is less than, that required to optimally fill the quadrupole ion trap 220, that is, for example, to provide optimal signal to noise ratio and acceptable space charge effects in the quadrupole ion trap 220.

For situations (A) and (B), the laser is once again operated for a predetermined number of shots (step 450), which can be the same or a lower of number of shots used for the AIC measurement, typically in the same location on the sample plate 110, as in step 410.

In one implementation, the optimal number of ions can be accumulated in the RF quadrupole ion trap 220 by firing a number of laser shots in step 450, where the number of shots can be equal to or less than that of the pre-experiment, and the resulting ions (or ions derived from those ions) can be transferred to and/or accumulated in the ion trap without attenuation (step 475).

Alternatively, the optimal number of ions can be accumulated in the RF quadrupole ion trap 220 by firing a whole number of laser shots in step 450, where the number of shots is equal to or less than that of the pre-experiment, and the ions can be attenuated prior to accumulation in the RF quadrupole ion trap 220 in step 470. This can be useful or necessary where, for example, the AIC test determines that less than a single ionization event is required to generate an analysis packet containing the desired population of ions, in which case ions can be accumulated for a single ionization event, and the accumulated ions can be attenuated to provide an analysis packet of the desired size. Similarly, if the AIC test determines that a fractional number of ionization events is required, ions can be accumulated for the next largest whole number of ionization events, and the accumulated ions can be attenuated to provide for an analysis packet of the desired size.

In one implementation, this attenuation is provided by attenuating via ion optics (step 465) the ion packet(s) before the ions are transferred (step 470) into the RF quadrupole ion trap 220.

In another implementation, the attenuation is provided by transferring the ion packet(s) to the storage device 305 (step 455), and then manipulating the storage device 305 such that only a portion of the ions are transferred (step 460) and subsequently accumulated in the RF quadrupole ion trap 220 (step 470).

In each of the above cases, the attenuation in step 450 is implemented step-wise to reduce the number of shots or ion packets, for example three shots which generated three ion packets, down to one ion packet, not portions thereof. Final attenuation of a single or combined ion packet occurs in steps 465 or 460 if more precise adjustment of ion population is required based on AIC test results.

In each of the above cases, during transfer or some time thereafter, any remaining low-mass matrix ions can be removed from the ion trap (step 485), although not required, before performing mass analysis (step 490) on substantially the entire contents of the RF quadrupole ion trap 220.

For situation (C), the laser is operated for the number of shots (determined in the AIC test) required to provide the desired ion population (step 480), typically in the same location on the sample plate 110 as in step 410, and the ion packets generated are accumulated directly in the quadrupole ion trap 220 in step 470. The ion packets accumulated in quadrupole ion trap 220 should contain the full optimal quota of ions, the complete combined ion packet within the m/z range of interest, required to accommodate space charge effects, and the optimal number of ions to provide useful and meaningful results with a tolerable signal to noise ratio. As above, during transfer or some time thereafter, any remaining low-mass matrix ions can be removed from the ion trap in step 485, and mass analysis can then be performed on substantially the entire contents of the quadrupole ion trap 220 in step 490. In the event that a greater number of shots is required than the pre-experiment, but attenuation is still required, the attenuation methods described above can be used.

Ideally, a single AIC test should provide a definite determination of the number of laser shots required for the analytical scan, whether one needs to increase the ion population by applying more laser shots to generate the analysis packet, or decrease the population by applying fewer laser shots, or by attenuating the results of a single shot.

Making predictions about ion populations created in 10–15 laser shots based on AIC measurements for a single-shot ion packet is more difficult than if a larger number of shots were used for the AIC measurement (say 2 or 5 laser shots). Experiments have shown that the analysis of samples in amounts smaller than about 25–50 fmol is more accurate if 2–3 shots for the AIC measurement are applied. More time is needed when several laser shots are applied in the initial AIC test, but this is not a significant portion of the overall time to complete the entire analysis. These techniques are particularly valuable for low concentration samples.

If it is determined in the pre-experiment that only a small number of shots—for example, a single shot—of the laser is required to fill the RF linear ion trap optimally, it may be beneficial to apply a larger number of laser shots and attenuate the ions by an appropriate factor. Thus, for example, if the AIC experiment uses three laser shots and determines that only one shot is required to yield the optimum ion population, rather than using only a single laser shot in the analysis scan it may be preferable to apply three laser shots and attenuate the resulting ions by a factor of three. This would be beneficial if the repeatability or confidence level that one had in obtaining the optimal number of ions in one shot was low. By taking three single shots, and effectively averaging the result, the chances of attaining the optimal population of ions are increased.

If $MS^N$ operation is desired, a population of ions is collected in the storage device 305, which is typically disposed after ion transfer optics 230. In this example, the storage device serves as a fragmentation cell, enabling ions that have or have acquired sufficient kinetic energies upon collision with an appropriate background gas to provide product ions. Substantially all these product ions are then transported to the RF quadrupole ion trap 220. A pre-experiment AIC test is then carried out by operating the RF quadrupole ion trap 220 such that ions are ejected towards detector 240. From the pre-experiment AIC test, the ion population required to provide for the desired population of product ions can be determined. As described previously, any matrix ions may have already been removed from this population prior to any AIC measurement.

As described above, the ions for use in an $MS^N$ mode are regulated in the form of "product ions". This regulation will be based on several assumptions, including the assumption that the yield of product ions resulting from precursor ions will be substantially constant under relatively constant operating conditions.

Figure 5:
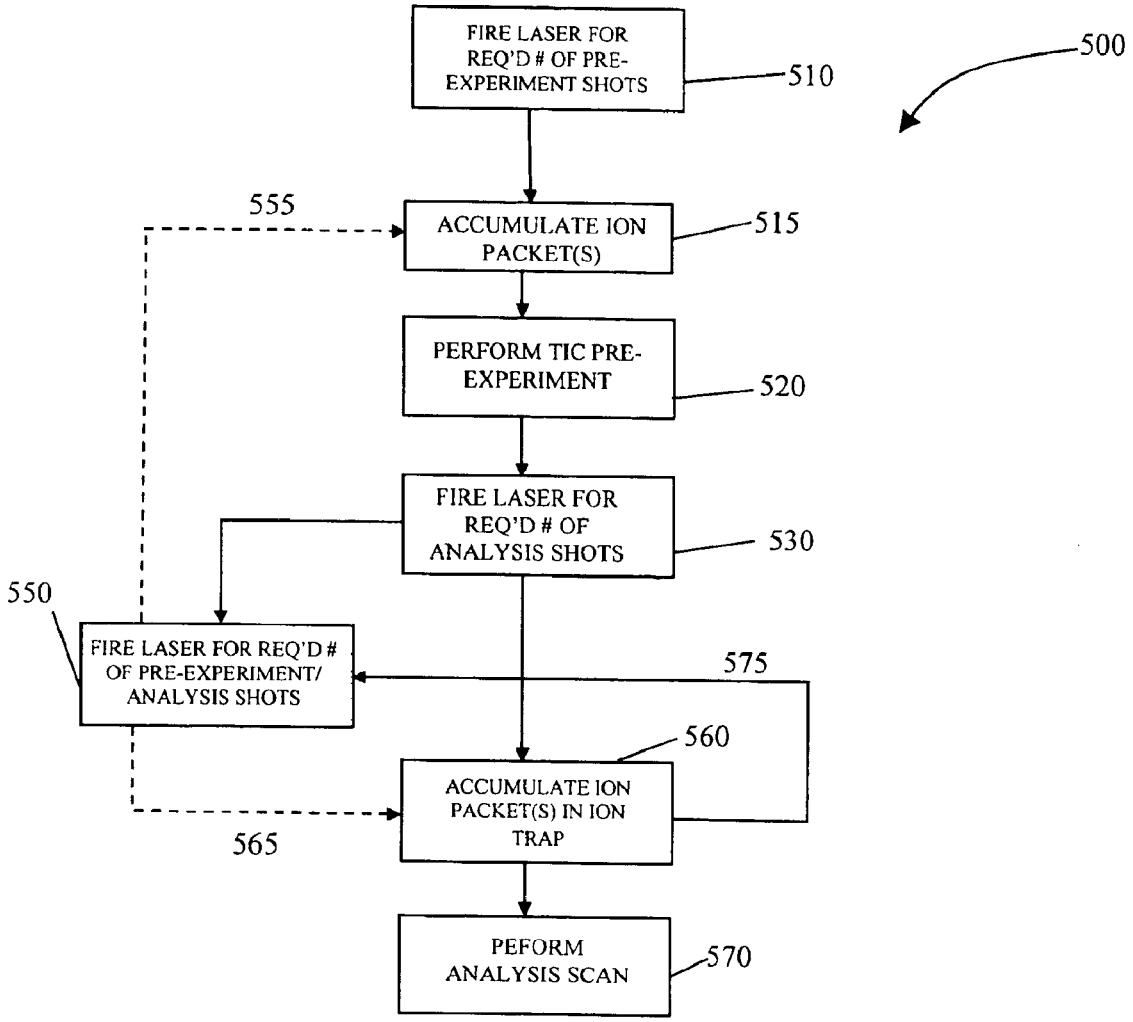
FIG. 5 is a flow diagram illustrating an implementation of a method according to another aspect of the invention.

FIG. 5 illustrates an alternative method 500 resulting in an improved duty cycle when the laser operates at a high repetition rate, characterized by larger transfer plus AIC test time than the time interval between laser pulses. In method 500, the predetermined number of laser shots for the pre-experiment (e.g., one to five shots as discussed above) are fired from the laser (step 510), and the ion packets that are generated therefrom traverse towards the RF quadrupole ion trap 230 where they are accumulated (step 515). The AIC pre-experiment is then performed (step 520) on the entire combined ion packet generated by the predetermined number of laser shots. In the pre-experiment, the number of shots that will be required for the actual analysis scan is estimated from the AIC pre-experiment. The laser is then fired the appropriate number of times for the analysis scan (step 530), as determined in the pre-experiment, and the ion packets generated therefrom traverse towards the RF quadrupole ion trap 230, where they are accumulated (step 560). During this traversal time, it is possible to continue firing the laser to generate ions for additional pre-experiments or to accumulate a second analysis quota of ions. In this manner, when the analysis scan has been performed on the first quota of ions (the first combined ion packet), a second set of either pre-experiment or analysis ions (the second combined ion packet) has already been accumulated in one of the RF multipoles for subsequent pre-experiment or full analysis. Thus the duty-cycle is increased.

In method 500, the first combined ion packet must be separated from the second combined ion packet. That is, the first combined ion packet should be isolated in both time and space from the second combined ion packet. This can be achieved, for example, by selecting appropriate conditions, e.g., the appropriate laser repetition rate, pressures in the various multipoles, and/or length of the storage device or multipole.

It has been found that data for the optimized number of laser shots obtained in the first location of the particular well on the sample plate provides a good basis for further AIC analysis when the laser target is moved to another location on the same particular well. However, a AIC test at the new location may still be required due to non-uniformity (lack of homogeneity) of sample distribution on the surface.

To optimally control the population of ions ultimately transferred to the mass analyzer, two or more pre-experiments may be beneficial. By taking the average of the population results from two or more pre-experiments, the user can have greater confidence that the optimal population of ions being accumulated and analyzed.

The above embodiments of the invention are described in the context of a MALDI ion source that can be interfaced to an RF quadrupole ion trap mass spectrometer and optimized for maximum transmission and beneficial ion packet characteristics.

These embodiments may be utilized in situations where the RF quadrupole ion trap is not the final analyzing device, but a means to control the population of ions entering a subsequent analyzing device. For example, the MALDI/RF quadrupole ion trap system may be incorporated ahead of an FT-ICR system, or some other analyzer, thereby facilitating the filling of the ICR or other such system. As described above, an additional storage device can employed in instances where the ion trap does not have sufficient capacity to fill the subsequent analyzer.

The methods of the invention can be implemented in digital electronic circuitry, or in computer hardware, firmware, software, or in combinations of them. The methods of the invention can be implemented as a computer program product, i.e., a computer program tangibly embodied in an information carrier, e.g., in a machine-readable storage device or in a propagated signal, for execution by, or to control the operation of, data processing apparatus, e.g., a programmable processor, a computer, or multiple computers. A computer program can be written in any form of programming language, including compiled or interpreted languages, and it can be deployed in any form, including as a stand-alone program or as a module, component, subroutine, or other unit suitable for use in a computing environment. A computer program can be deployed to be executed on one computer or on multiple computers at one site or distributed across multiple sites and interconnected by a communication network.

Method steps of the invention can be performed by one or more programmable processors executing a computer program to perform functions of the invention by operating on input data and generating output. Method steps can also be performed by, and apparatus of the invention can be implemented as, special purpose logic circuitry, e.g., an FPGA (field programmable gate array) or an ASIC (application-specific integrated circuit).

Processors suitable for the execution of a computer program include, by way of example, both general and special purpose microprocessors, and any one or more processors of any kind of digital computer. Generally, a processor will receive instructions and data from a read-only memory or a random access memory or both. The essential elements of a computer are a processor for executing instructions and one or more memory devices for storing instructions and data. Generally, a computer will also include, or be operatively coupled to receive data from or transfer data to, or both, one or more mass storage devices for storing data, e.g., magnetic, magneto-optical disks, or optical disks. Information carriers suitable for embodying computer program instructions and data include all forms of non-volatile memory, including by way of example semiconductor memory devices, e.g., EPROM, EEPROM, and flash memory devices; magnetic disks, e.g., internal hard disks or removable disks; magneto-optical disks; and CD-ROM and DVD-ROM disks. The processor and the memory can be supplemented by, or incorporated in special purpose logic circuitry.

To provide for interaction with a user, the invention can be implemented on a computer having a display device, e.g., a CRT (cathode ray tube) or LCD (liquid crystal display) monitor, for displaying information to the user and a keyboard and a pointing device, e.g., a mouse or a trackball, by which the user can provide input to the computer. Other kinds of devices can be used to provide for interaction with a user as well; for example, feedback provided to the user can be any form of sensory feedback, e.g., visual feedback, auditory feedback, or tactile feedback; and input from the user can be received in any form, including acoustic, speech, or tactile input.

The invention has been described in terms of particular embodiments. Other embodiments are within the scope of the following claims. For example, the steps of the methods illustrated and described above can be performed in a different order and still achieve desirable results. The apparatus illustrated and described can include other components in addition to those explicitly described, which may be required for certain applications. Some limitations to these techniques may apply, such as the effect of laser power instability and history of sample ablation. The various features explained on the basis of the various exemplary embodiments can be combined to form further embodiments of the invention.

What is claimed is:

1. A method for operating a mass spectrometer, the method comprising:

a) generating a test packet of ions from a pulsed ion source;

b) detecting a population of ions derived from the test packet of ions;

c) based on the detected population, determining a number of ionization events of the pulsed ion source required to provide an analysis packet of ions expected to have a desired population of ions; and d) providing an analysis packet of ions by accumulating ions for the determined number of ionization events.

2. The method of claim 1, wherein:

steps (a) through (d) are performed in the order recited.

3. The method of claim 1, wherein:

generating a test packet includes firing a predetermined number of laser shots at an analyte disposed on a sample plate.

4. The method of claim 3, further comprising:

accumulating the test packet of ions in an ion storage device.

5. The method of claim 4, wherein:

determining a number of pulsed ionization events based on the detected population includes estimating an accumulated ion charge of the accumulated test packet of ions.

6. The method of claim 4, wherein:

the ion storage device includes a multipole ion guide.

7. The method of claim 4, further comprising:

removing substantially all ions derived from the test packet of ions from the ion storage device before accumulating ions for the determined number of ionization events.

8. The method of claim 4, further comprising:

transferring at least a portion of the analysis packet of ions to a mass analyzer of the mass spectrometer.

9. The method of claim 8, wherein:

the mass analyzer includes the ion storage device.

10. The method of claim 4, wherein:

the desired population of ions is defined as a population of ions expected to have a desired behavior in the ion storage device.

11. The method of claim 3, wherein:

determining a number of ionization events includes determining a number of laser shots required to provide an analysis packet of ions expected to have a desired population of ions; and generating the analysis packet of ions includes accumulating ions for the determined number of laser shots.

12. The method of claim 11, wherein:

generating the analysis packet of ions includes accumulating ions for a determined number of laser shots that is less than or equal to the predetermined number of laser shots.

13. The method of claim 11, wherein:

generating the analysis packet of ions includes accumulating ions for a determined number of laser shots that is greater than the predetermined number of laser shots.

14. The method of claim 11, wherein:

generating the analysis packet of ions includes generating ions for the determined number of laser shots and accumulating an attenuated amount of the generated ions to provide the analysis packet.

15. The method of claim 1, wherein:

the pulsed ion source is a MALDI ion source.

16. The method of claim 1, wherein:

detecting ions derived from the test packet of ions includes detecting ions in the test packet of ions.

17. The method of claim 1, wherein generating a test packet of ions includes:

generating one or more pulses of ions in the pulsed ion source; accumulating the ions in the generated pulses of ions; and generating product ions from the ions accumulated from the generated pulses of ions;

wherein detecting a population of ions derived from the test packet of ions includes detecting at least a portion of the generated product ions.

18. The method of claim 17, wherein:

generating the analysis packet of ions includes generating product ions from the ions accumulated for the determined number of ionization events.

19. The method of claim 1, wherein:

the desired population of ions is defined as a population of ions expected to have a desired behavior in the mass spectrometer.

20. A mass analyzing apparatus, comprising:

a pulsed source of ions;

a detector disposed to receive ions generated by the source of ions;

an ion storage device disposed and configured to receive ions derived from the ions generated by the source of ions;

a programmable processor in communication with the detector and the ion storage device, the processor being operable to:

determine a number of pulsed ionization events required to produce an analysis packet of ions expected to have a desired population of ions; cause the pulsed source of ions to generate the determined number of pulsed ionization events; and cause the ion storage device to accumulate substantially all of the analysis packet of ions.

21. The apparatus of claim 20, wherein:

the programmable processor is operable to determine the number of pulsed ionization events based on a detected ion population in a test packet of ions accumulated in the ion storage device.

22. The apparatus of claim 21, wherein:

the programmable processor is operable to determine the number of pulsed ionization events by estimating an accumulated ion charge of the accumulated test packet of ions.

23. The apparatus of claim 21, wherein:

the pulsed source of ions includes a laser; and the programmable processor is operable to determine the number of ionization events by determining a number of laser shots required to provide an analysis packet of ions expected to have a desired population of ions.

24. The apparatus of claim 20, wherein:

the pulsed source of ions is a MALDI ion source.

25. A computer program product, tangibly embodied on a computer readable medium, for controlling the operation of a mass spectrometer, the product including instructions operable to cause data processing apparatus to perform operations comprising:

causing a pulsed ion source to generate a test packet of ions from a pulsed ion source;

receiving a signal indicative of detecting a population of ions derived from the test packet of ions;

determining, based on the received signal, a number of ionization events of the pulsed ion source required to provide an analysis packet of ions expected to have a desired population of ions;

causing the pulsed ion source to generate ions for the determined number of ionization events; and causing an ion storage device to accumulate an analysis packet of ions derived from the ions generated for the determined number of ionization events.

26. The computer program product of claim 25, wherein:

the product is operable to cause data processing apparatus to cause the pulsed ion source to generate a test packet by firing a predetermined number of laser shots at an analyte disposed on a sample plate.

27. The computer program product of claim 26, wherein:

the product is operable to cause data processing apparatus to cause an ion storage device to accumulate the test packet of ions.

28. The computer program product of claim 27, wherein:

the product is operable to cause data processing apparatus to determine a number of pulsed ionization events by estimating an accumulated ion charge of the accumulated test packet of ions.

29. The computer program product of claim 27, wherein:

the product is operable to cause data processing apparatus to determine a number of ionization events by determining a number of laser shots required to provide an analysis packet of ions expected to have a desired population of ions; and the product is operable to cause data processing apparatus to cause the ion storage device to accumulate ions for the determined number of laser shots to provide the analysis packet.

30. The computer program product of claim 29, wherein:

the product is operable to cause data processing apparatus to cause the pulsed ion source to generate the analysis packet by performing a determined number of laser shots that is less than or equal to the predetermined number of laser shots.

31. The computer program product of claim 29, wherein:

the product is operable to cause data processing apparatus to the pulsed ion source to generate the analysis packet by performing a determined number of laser shots that is greater than the predetermined number of laser shots.

32. The computer program product of claim 31, wherein:

the product is operable to cause data processing apparatus to cause the pulsed ion source to generate the analysis packet by performing the determined number of laser shots, and to cause the ion storage device to accumulate an attenuated amount of the generated ions to provide the analysis packet.

33. The computer program product of claim 27, wherein:

the product is operable to cause data processing apparatus to cause the ion storage device to transfer at least a portion of the analysis packet of ions to a mass analyzer of the mass spectrometer.

34. The computer program product of claim 33, wherein:

the mass analyzer includes the ion storage device.

35. The computer program product of claim 27, wherein:

the desired population of ions is defined as a population of ions expected to have a desired behavior in the ion storage device.

36. The computer program product of claim 25, wherein:

the pulsed ion source is a MALDI ion source.

37. The computer program product of claim 25, wherein causing the pulsed ion source to generate a test packet of ions includes:

causing the pulsed ion source to generate one or more pulses of ions in the pulsed ion source;

causing an ion storage device to accumulate the ions in the generated pulses of ions; and causing the ion storage device to generate product ions from the ions accumulated from the generated pulses of ions;

wherein detecting a population of ions derived from the test packet of ions includes detecting at least a portion of the generated product ions.

38. The computer program product of claim 37, wherein:

causing the pulsed ion source to generate the analysis packet of ions includes causing the ion storage device to generate product ions from the ions accumulated for the determined number of ionization events.

39. The computer program product of claim 25, wherein:

the desired population of ions is defined as a population of ions expected to have a desired behavior in the mass spectrometer.

* * * * *